US008960577B2

(12) United States Patent
Tjell et al.

(10) Patent No.: US 8,960,577 B2
(45) Date of Patent: Feb. 24, 2015

(54) METHOD AND A DEVICE FOR SENSING THE PROPERTIES OF A MATERIAL TO BE CRUSHED

(75) Inventors: Bengt Olof Tjell, Genarp (SE); Christian Ottergren, Trelleborg (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 14/237,624

(22) PCT Filed: Jun. 29, 2012

(86) PCT No.: PCT/EP2012/062655

§ 371 (c)(1),
(2), (4) Date: Feb. 7, 2014

(87) PCT Pub. No.: WO2013/020755

PCT Pub. Date: Feb. 14, 2013

(65) Prior Publication Data

US 2014/0166791 A1 Jun. 19, 2014

(30) Foreign Application Priority Data

Oct. 8, 2011 (EP) ..... 11177045

(51) Int. Cl.

| | |
|---|---|
| ***B02C 25/00*** | (2006.01) |
| ***B02C 4/32*** | (2006.01) |
| ***B02C 2/02*** | (2006.01) |
| ***B02C 1/02*** | (2006.01) |
| ***B02C 2/04*** | (2006.01) |

(52) U.S. Cl.

CPC ... *B02C 2/02* (2013.01); *B02C 1/02* (2013.01); *B02C 2/042* (2013.01); *B02C 25/00* (2013.01)

USPC ..... 241/30; 241/33; 241/34

(58) Field of Classification Search

USPC ..... 241/33–37, 207–216, 30

See application file for complete search history.

(56) References Cited

U.S. PATENT DOCUMENTS

| | | | | |
|---|---|---|---|---|
| 4,804,148 | A * | 2/1989 | Etheridge | 241/35 |
| 6,123,279 | A * | 9/2000 | Stafford et al. | 241/30 |
| 6,932,289 | B2 | 8/2005 | Musil | |
| 7,360,726 | B2 * | 4/2008 | Nilsson et al. | 241/30 |

FOREIGN PATENT DOCUMENTS

| | | | | |
|---|---|---|---|---|
| EP | 306594 | A1 * | 3/1989 | B02C 25/00 |
| EP | 2116307 | A1 | 11/2009 | |

* cited by examiner

*Primary Examiner* — Faye Francis
(74) *Attorney, Agent, or Firm* — Corinne Gorski

(57) ABSTRACT

A method of crushing material between a first crushing surface and a second crushing surface of a crusher, including the steps of measuring a crushing parameter, and analyzing, based on the measured crushing parameter, which type of material that is being crushed in the crusher.

12 Claims, 3 Drawing Sheets

METHOD AND A DEVICE FOR SENSING THE PROPERTIES OF A MATERIAL TO BE CRUSHED

RELATED APPLICATION DATA

This application is a §371 National Stage Application of PCT International Application No. PCT/EP2012/062655 filed Jun. 29, 2012, claiming priority of EP Application No. 11177045.9, filed Aug. 10, 2011.

TECHNICAL FIELD OF THE INVENTION

The present invention relates to a method of crushing material between a first crushing surface and a second crushing surface of a crusher. The present invention further relates to a crushing system comprising a crusher having a first crushing surface and a second crushing surface for crushing a material there between.

BACKGROUND OF THE INVENTION

A crusher may be utilized for efficient crushing of material, such as stone, ore, etc. into smaller sizes. Such crushing is often one of the steps in converting, for example, rock obtained from blasting in mines, from blasting in conjunction with road projects, from demolition of buildings, etc. into a particulate material that can be useful in a smelting plant, as a filling material for road construction, etc.

One example of a crusher type useful for crushing larger objects into useful particulate material is the inertia cone crusher, an example of which is disclosed in EP 2 116 307. In such an inertia cone crusher material is crushed between an outer crushing shell, which is mounted in a frame, and an inner crushing shell, which is mounted on a crushing head. The crushing head is mounted on a crushing shaft. An unbalance weight is arranged on a cylindrical sleeve encircling the crushing shaft. A motor is operative for rotating the cylindrical sleeve. Such rotation causes the unbalance weight to rotate and to swing to the side, causing the crushing shaft, the crushing head and the inner crushing shell to gyrate and to crush material that is fed to a crushing chamber formed between the inner and outer crushing shells. The crusher may be controlled to yield a desired composition of the crushed product.

SUMMARY OF THE INVENTION

An object of the present invention is to provide an efficient method of crushing various types of materials.

This object is achieved by a method of crushing material between a first crushing surface and a second crushing surface of a crusher, the method comprising measuring a crushing parameter, and analysing, based on the measured crushing parameter, which type of material that is being crushed in the crusher.

An advantage of this method is that the crusher itself is used as a measurement instrument to detect what type of material that is crushed at a certain occasion. Hence, in a very efficient manner, and requiring a limited investment, it becomes possible to analyse which type of material that is currently crushed in the crusher.

According to one embodiment the step of analysing which type of material that is being crushed in the crusher includes analysing which of at least two different materials that is being crushed in the crusher. An advantage of this embodiment is that if two different materials are crushed in the crusher the operation of a crushing plant can be adapted accordingly, to obtain efficient performance for each respective type of material.

According to one embodiment the method further comprises, subsequently to analysing which type of material that is being crushed in the crusher, determining whether or not a change of material being crushed has occurred. An advantage of this embodiment is that changes in the material being crushed can be automatically detected, so that suitable measures can be taken to adapt the crushing process accordingly.

According to one embodiment the method further comprises selecting a destination, from at least two alternative destinations, to which the crushed material is to be forwarded based on the analysis of which type of material that is being crushed in the crusher. An advantage of this embodiment is that the crushed material may be automatically forwarded to a suitable location, of at least two possible locations, based on from which type of material the crushed material originates.

According to one embodiment the method further comprises selecting a setting for at least one crusher operating parameter, from at least two alternative settings of the crusher operating parameter, based on the analysis of which type of material that is being crushed in the crusher. An advantage of this embodiment is that the crusher may, after detecting what type of material is crushed in the crusher, be controlled to crush the material in question in the most suitable manner with regard to the intended use of the crushed material in question.

According to one embodiment the method further comprises selecting a setting for at least one operating parameter of downstream equipment treating crushed material coming from the crusher, from at least two alternative settings of the operating parameter, based on the analysis of which type of material that is crushed in the crusher. An advantage of this embodiment is that further treatment of the crushed material in a mill, a flotation device, a screen or other downstream equipment receiving crushed material from the crusher, could be made as efficient as possible, utilizing the information about the type of material that is being crushed.

According to one embodiment the crushing parameter includes the power consumption of the crusher. An advantage of this embodiment is that the power consumption is easy to measure and often provides relevant information of the material being crushed.

A further object of the present invention is to provide a crushing system which is efficient in crushing various types of materials.

This object is achieved by a crushing system comprising a crusher having a first crushing surface and a second crushing surface for crushing a material there between, the crushing system further comprising a control system adapted to measure at least one crushing parameter, and to analyse, based on the at least one crushing parameter, which type of material that is being crushed in the crusher.

An advantage of this crushing system is that the crusher becomes in itself a measurement instrument for sensing what type of material is being crushed in the crusher. Based on such information obtained crushing performance and setting of the crushing system may be controlled more efficiently. Furthermore, the operation of a downstream processing apparatus, such as a mill or a flotation device, arranged for further treating crushed material coming from the crusher, may also be controlled based on information about what type of material that is being crushed.

According to one embodiment the crushing system further comprises a material collecting station arranged for collecting material crushed in the crusher, the control system being adapted to control the material collecting station based on the type of material that is being crushed in the crusher. An advantage of this embodiment is that different types of material can be forwarded to different locations, optionally for being further processed in different manners.

According to one embodiment the control system is adapted to control at least one crusher operating parameter of the crusher based on the analysed type of material that is being crushed in the crusher. An advantage of this embodiment is that the crushing procedure may be optimized for the material being crushed at a certain occasion.

According to one embodiment the crusher is a crusher selected among gyratory crushers and jaw crushers. An advantage of this embodiment is that gyratory crushers and jaw crushers are suitable for crushing different types of materials. Furthermore, these types of crushers can be controlled to crush two different types of materials in two different manners.

According to one embodiment the crusher is an inertia cone crusher. An inertia cone crusher is easily controlled to crush two different types of materials in two different manners. Hence, with an inertia cone crusher two materials being very different from each other as regards their properties can be crushed in one and the same crusher, and the crushing system is able to detect which of two such materials that is crushed at a certain occasion.

Further objects and features of the present invention will be apparent from the following detailed description and claims.

BRIEF DESCRIPTION OF THE DRAWINGS

The invention is described in more detail below with reference to the appended drawings in which.

DESCRIPTION OF PREFERRED EMBODIMENTS

Figure 1:
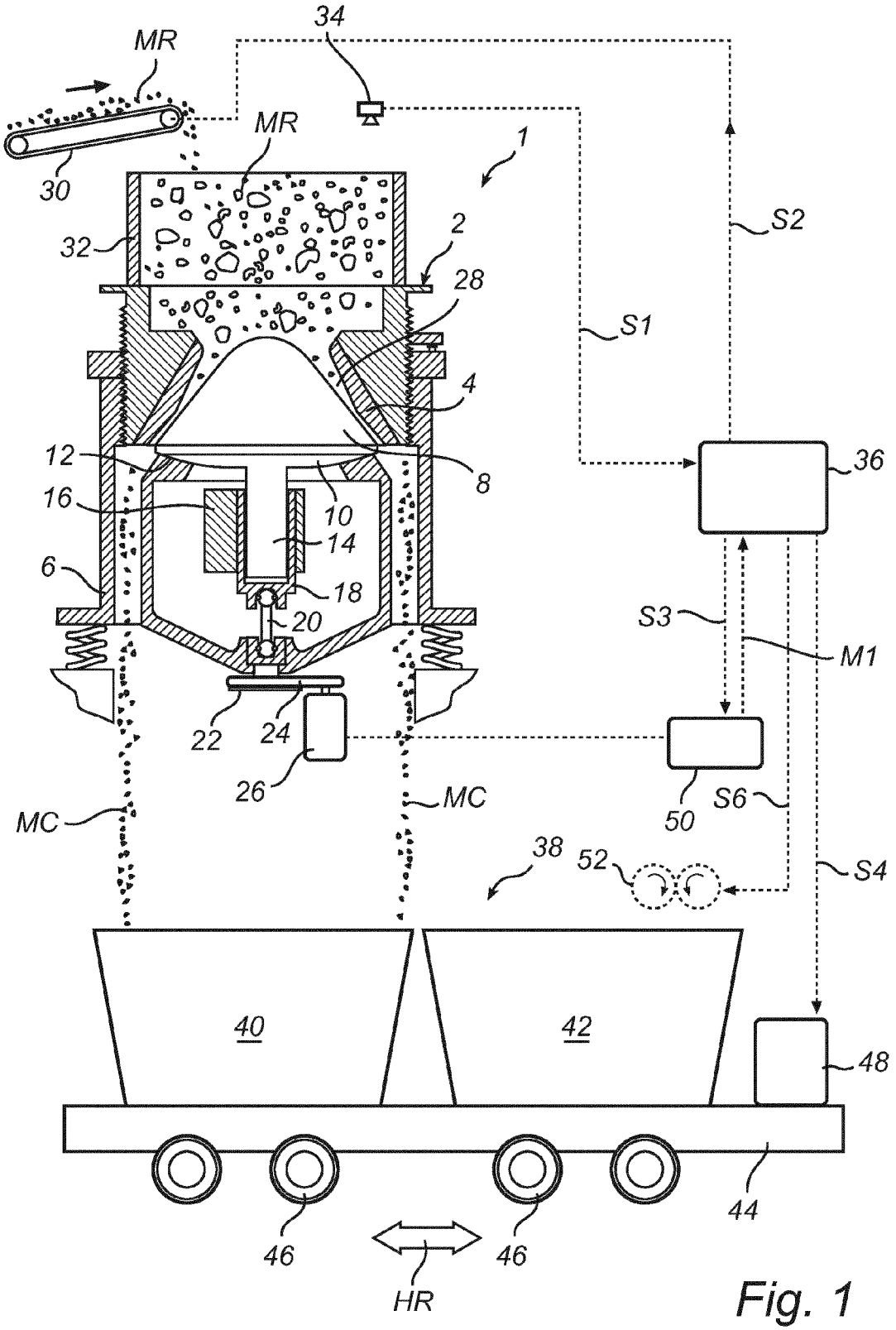
FIG. 1 is a schematic side view of a crushing system according to a first embodiment.

FIG. 1 illustrates schematically a crushing system 1 according to a first embodiment. The crushing system 1 comprises a gyratory crusher 2 which is of the inertia cone crusher type. The crusher 2 comprises a first crushing surface in the form of an outer crushing shell 4, which is mounted in a frame 6, and a second crushing surface in the form of an inner crushing shell 8, which is mounted on a crushing head 10. The crushing head 10 is supported on a spherical bearing 12. The crushing head 10 is mounted on a crushing shaft 14. An unbalance weight 16 is arranged on a cylindrical sleeve 18 encircling the crushing shaft 14. The cylindrical sleeve 18 is, via a drive shaft 20, connected to a pulley 22. The pulley 22 is, via a drive belt 24, connected to a crusher motor 26. The crusher motor 26 is operative for rotating the pulley 22, and, hence, the cylindrical sleeve 18. Such rotation of the sleeve 18 causes the unbalance weight 16 to rotate and to swing to the side, causing the crushing shaft 14, the crushing head 10, and the inner crushing shell 8 to gyrate and to crush material that is fed to a crushing chamber 28 formed between the outer and inner crushing shells 4, 8. The crushing force exerted on the material MR in the crushing chamber 28 is related to the rpm at which the crusher motor 26 rotates the cylindrical sleeve 18 and the unbalance weight 16, with higher rpm's resulting in a higher crushing force.

A material supply conveyor 30 is arranged for transporting material MR to be crushed to the gyratory crusher 2, and to drop the material MR to be crushed into a hopper 32 arranged above the crushing chamber 28. A level sensor 34 is arranged above the hopper 32 to measure the amount of material MR to be crushed that is present in the hopper 32. A control system 36 receives a signal 51 from the level sensor 34 indicative of the amount of material present in the hopper 32. Based on such signal the control system 36 sends a control signal S2 to the material supply conveyor 30 to supply a suitable amount of material MR to the hopper 32 to keep the level of material MR constant in the hopper 32. Typically, the control system 36 controls the supply conveyor 30 to keep the hopper 32 full of material MR.

After being crushed in the crushing chamber 28 crushed material MC falls vertically downwards from crusher 2. A material collecting station 38 is arranged below the crusher 2 to collect the crushed material MC. In the embodiment illustrated in FIG. 1 the collecting station 38 is schematically illustrated as comprising a first collecting bin 40 for collecting a first type of crushed material and a second collecting bin 42 for collecting a second type of crushed material. In the embodiment illustrated in FIG. 1 the first and second collecting bins 40, 42 are arranged on a trailer 44 having wheels 46 and a drive motor 48 for moving the trailer 44 horizontally, as indicated by an arrow HR. The drive motor 48 may move the trailer 44 between a first position, which is indicated in FIG. 1, in which the first collecting bin 40 is positioned below the crusher 2 for collecting crushed material MC, and a second position, in which the second collecting bin 42 is positioned below the crusher 2 for collecting crushed material MC. It will be appreciated that although FIG. 1 illustrates first and second collecting bins 40, 42, the collecting station 38 could equally well comprise one or more conveyors transporting the crushed material to each of two, or more, locations. Furthermore, the collecting station 38 could also, as a further alternative, comprise a collecting hopper collecting crushed material MC. From such a hopper collected crushed material MC could be transported to each of at least two different locations.

The control system 36 is operative for sending a control signal S3 to a motor controller 50 to the effect that the crusher motor 26 should make the cylindrical sleeve 18, and hence the unbalance weight 16, rotate with a certain rpm, for example 500 rpm, to obtain a desired crushing force in the crushing chamber 28. The motor controller 50 controls the power supplied to the crusher motor 26 to cause the cylindrical sleeve 18, and hence the unbalance weight 16, to rotate at the desired rpm.

The motor controller 50 is operative for sending a measurement signal M1 to the control system 36. The measurement signal M1 contains information about the power, for example in kW, which is consumed by the crusher motor 26 for rotating the cylindrical sleeve 18 at the set rpm, for example 500 rpm.

The control system 36 analyses the information received from the motor controller 50 to determine what type of material that is presently crushed in the crusher 2. For example, in an iron mine two or more types of ore may exist: a first type of ore that is high-grade with respect to its content of iron, and which is comparably difficult to crush, and a second type of ore that is low-grade with respect to its content of iron, and which is comparably easy to crush. With the first type of ore a moderate crushing of the material, for example from an average size of 100 mm to an average size of 10 mm is sufficient for preparing the first type of ore for use in iron production. With the second type of ore, on the other hand, an enrichment process is to be carried out before the second type of ore is to be used in iron production. Such enrichment is made with a relatively fine ground material. Hence, with the second type of ore a vigorous crushing of the material, for example from an average size of 100 mm to an average size of 4 mm, is suitable for preparing the second type of ore for enrichment. It may often be difficult to know what type of material, the first or the second type of ore, which is presently fed to the crusher 2 from the conveyor 30.

The control system 36 may compare a power consumption measured by motor controller 50 to a set of power data representative for the various materials that exist in the mine. The set of power data could comprise a matrix of possible materials, and corresponding power consumed at various rpm's. A schematic example is illustrated in table 1:

TABLE 1

Power consumed by high-grade and low-grade ores at different rpm's

| Ore type | 500 rpm | 600 rpm |
|---|---|---|
| High-grade | 400 kW | 800 kW |
| Low-grade | 200 kW | 400 kW |

The control system 36 uses the crusher 2 as a measurement instrument to determine which type of ore that is presently crushed in the crusher 2. If, for example, the control system 36 has sent a signal S3 to the motor controller 50 ordering an rpm of 500 rpm, and the measured power, as forwarded in signal M1, is 200 kW, then the control system 36 may determine that the material MR presently fed to the crusher 2 is the low-grade ore material. The control system 36 may then send a signal S4 to the drive motor 48 of the collecting station 38 to the effect that the drive motor 48 is to move the trailer 44 to such a position that the first collecting bin 40 becomes located below the crusher 2 and collects the crushed material MC, as is illustrated in FIG. 1. If, on a later occasion, the measured power increases to 400 kW, still at an rpm of 500 rpm of the crusher motor 26, then the control system 36 may determine that the material MR now being fed to the crusher 2 is the high-grade material. In response to such finding, the control system 36 may send a signal S4 to the drive motor 48 of the collecting station 38 to the effect that the drive motor 48 is to move the trailer 44 to such a position that the second collecting bin 42 becomes located below the crusher 2 and collects the crushed material MC. Hence, the control system 36 uses the crusher 2 as a measurement instrument to determine which type of material that is presently crushed in the crusher 2, and controls the collecting station 38 to collect crushed material MC of the low-grade ore material type in the first collecting bin 40, and to collect crushed material MC of the high-grade ore material type in the second collecting bin 42.

Still further, the control system 36 may also utilize the information received from the motor controller 50 to control the manner in which the material is to be crushed. As described hereinbefore, it is desirable to crush the high-grade ore material to an average size of about 10 mm, and the low-grade ore material to an average size of about 4 mm. To this end, the crushing of the low-grade ore material could be performed at an rpm of 600 rpm to achieve efficient crushing to the desired sizes. Hence, looking at table 1, if the control system 36 has sent a signal S3 to the motor controller 50 to perform crushing at 500 rpm, for high-grade ore material, and the power decreases from 400 kW to 200 kW, then the control system 36 may determine that low-grade ore material is now fed to the crusher 2. In response to such a finding the control system 36 may send a signal S3 to the motor controller 50 to the effect that the rpm of the crusher motor is to be increased to 600 rpm to achieve efficient crushing of the low-grade ore material. In accordance with one embodiment, the control system 36 may, simultaneously, send a signal S4 to the collecting station 38 to collect such low-grade ore material in the first collecting bin 40, in accordance with the principles described hereinbefore. Then, if the power increases from 400 kW to 800 kW, then the control system 36 may, as indicated in table 1, determine that high-grade ore material is now fed to the crusher 2. In response to such a finding the control system 36 may send a signal S3 to the motor controller 50 to the effect that the rpm of the crusher motor 26 is to be decreased to 500 rpm to achieve efficient crushing of the high-grade ore material. A signal S4 may be sent to the collecting station 38 to collect the high-grade ore material in the second collecting bin 42. Hence, the control system 36 uses the crusher 2 as a measurement instrument to determine which type of material that is being crushed in the crusher 2. Based on such information, the control system 36 may control a destination of the crushed material MC, i.e., first or second collecting bin 40, 42, and/or control a crusher operating parameter, i.e., crushing at 500 or 600 rpm, influencing the crushing of the material.

Furthermore, the control system 36 may also utilize the information received from the motor controller 50 to control the operation of downstream apparatuses, i.e., equipment that is to further treat the crushed material MC. Examples of such downstream apparatuses include fine crushers, mills, screens, flotation devices, etc. In FIG. 1 a roller mill 52 is schematically illustrated. Crushed material MC may either be treated in the mill 52 immediately after leaving crusher 2, or after the crushed material MC has been transported away for further treatment. Based on a finding of a material type being crushed in the crusher 2, the control system 36 may send a signal S6 to control at least one operating parameter, such as a motor power, an rpm, or a gap between rollers, of the mill 52. For example, the control system 36 may send a signal S6 to the mill 52 and order the mill 52 to mill the crushed material MC at a first mill rpm on occasions when it has been determined that the crushed material MC is low-grade ore material, and to mill the crushed material MC at a second mill rpm, being different from the first mill rpm, on occasions when it has been determined that the crushed material MC is high-grade ore material.

Figure 2:
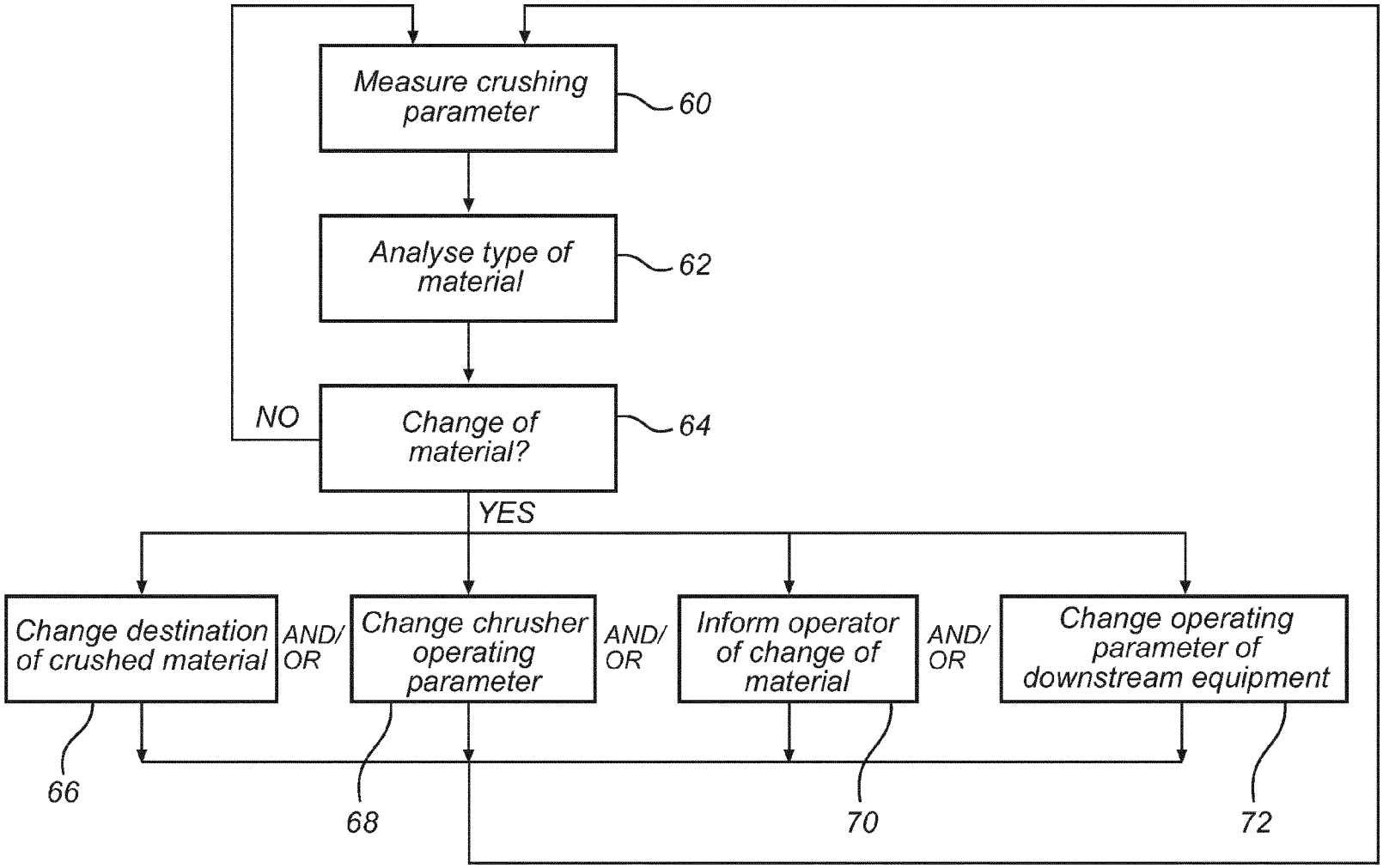
FIG. 2 is a schematic diagram illustrating a method of operating a crushing system.

FIG. 2 illustrates, schematically, a method of crushing material. In a first step 60 a crushing parameter, such as the power consumed by the crusher motor 26 for maintaining a certain rpm of the crusher 2, is measured.

In a second step 62 the crushing parameter measured is analysed to determine which type of material that is crushed. Such analysis could, for example, be based on the above illustrated table 1, or on a mathematical expression, a curve or similar, that illustrates the relation between the crushing parameter and the type of material being crushed.

In a third step 64 it is determined if the type of material that is being crushed in the crusher 2 has changed. If the answer to such question is "NO", then the step 60 and steps 62 and 64 are just repeated. If the answer to such question is "YES", then one or more of the steps 66, 68, 70 and 72 commences.

In a first alternative fourth step 66 the destination of the crushed material is changed. Such change of destination could involve controlling a conveyor, or a trailer 44, such that a change of material to be crushed from, for example, low-grade ore to high-grade ore, also involves changing the destination of the crushed material MC, from a storage location for low-grade ore to a storage location for high-grade ore.

In a second alternative fourth step 68 a crusher operating parameter is changed upon detecting that the material being crushed has changed. Such a crusher operating parameter may be the rpm of the crusher motor 26, a width of a gap between an outer crushing shell 4 and an inner crushing shell 8, or another parameter that influences the properties of the crushed material.

In a third alternative fourth step 70 an operator is informed of the change in the type of material being crushed in the crusher.

In a fourth alternative fourth step 72 an operating parameter of downstream equipment, such as a downstream apparatus in the form of, for example, a mill 52, treating crushed material MC coming from the crusher 2, is changed upon detecting that the material being crushed has changed. Hence, the crusher 2 may be utilized as a measurement instrument, and the information received from the crusher 2 concerning which type of material that is crushed at a certain occasion is utilized for controlling one or more downstream apparatuses 52 further treating the crushed material MC coming from the crusher 2.

The four alternative fourth steps 66, 68, 70 and 72 could be performed in any combination. Hence, in accordance with one example, the second alternative fourth step 68, change of crusher operating parameter, could be combined with informing the operator according to step 70 and controlling a parameter of a downstream apparatus according to step 72. In accordance with another example the first alternative fourth step 66 is the only step performed.

Figure 3:
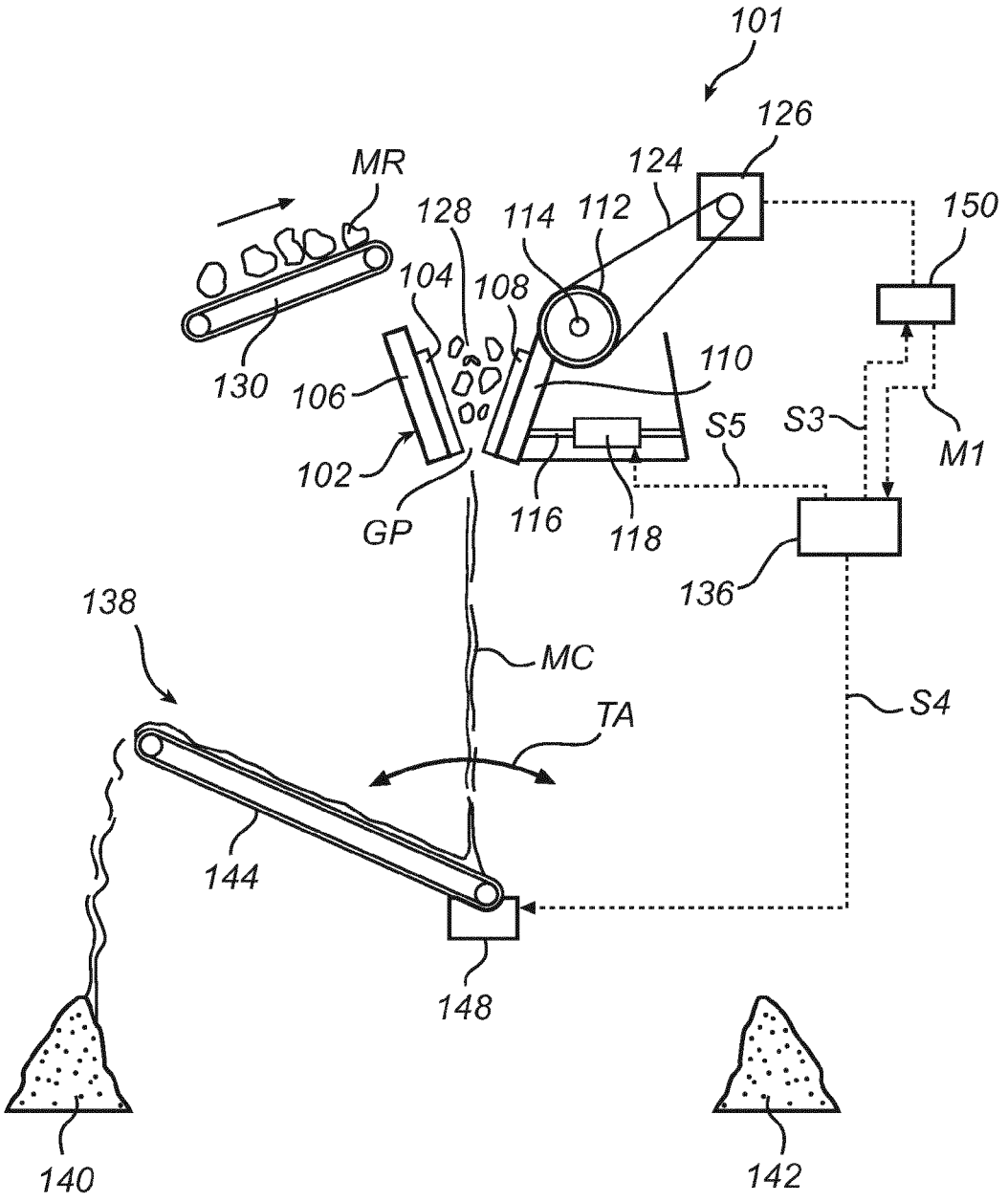
FIG. 3 is a schematic side view of a crushing system according to a second embodiment.

FIG. 3 illustrates schematically a crushing system 101 according to a second embodiment. The crushing system 101 comprises a jaw crusher 102. An example of a jaw crusher is described in U.S. Pat. No. 6,932,289. The jaw crusher 102 comprises a first crushing surface in the form of a fixed crushing plate 104, which is mounted in a frame 106, and a second crushing surface in the form of a movable crushing plate 108, which is mounted on a movable jaw 110. The movable jaw 110 is connected to a wheel 112 having an eccentric shaft 114 and a toggle plate 116. The toggle plate 116 is connected to a hydraulic cylinder 118 making it possible to control a gap GP between the fixed crushing plate 104 and the movable crushing plate 108. A crusher motor 126 is operative for rotating, by means of a drive belt 124, the wheel 112 and the eccentric shaft 114 to make the movable jaw 110 "chew" material MR fed from a material supply conveyor 130 to a crushing chamber 128 formed between the crushing plates 104, 108.

After being crushed in the crushing chamber 128 crushed material MC falls vertically downwards from crusher 102. A material collecting station 138 is arranged below the crusher 102 to collect the crushed material MC. In the embodiment illustrated in FIG. 3 the collecting station 138 comprises a conveyor 144 that can be turned, as illustrated by an arrow TA, between a first position, indicated in FIG. 3, in which crushed material MC is forwarded to a first material location 140, and a second position in which crushed material MC is forwarded to a second material location 142.

A control system 136 is operative for sending a control signal S3 to a motor controller 150 to the effect that the crusher motor 126 should make the movable jaw 110 oscillate with a certain frequency. Such frequency could be different for different materials, or be the same for all types of materials.

The motor controller 150 is operative for sending a measurement signal M1 to the control system 136. The measurement signal M1 contains information about the power, for example in kW, which is consumed by the crusher motor 126 for oscillating the movable jaw 110 with the set frequency.

The control system 136 analyses the information received from the motor controller 150 to determine what type of material that is presently crushed in the crusher 102 in accordance with principles similar to those described hereinbefore with reference to FIG. 1.

The control system 136 may compare a power consumption measured by motor controller 150 to a set of power data representative for the various materials that could be crushed. The various materials could involve materials with different degrees of impurities, such as clay or gravel, making them more or less easy to crush. The set of power data could comprise a matrix of possible materials, and corresponding power consumed at various widths of the gap GP. A schematic example is illustrated in table 2:

TABLE 2

Power consumed by various materials and at various gap widths

| Material type | Gap = 100 mm | Gap = 200 mm |
|---|---|---|
| Small amount of impurities | 400 kW | 200 kW |
| Large amount of impurities | 200 kW | 100 kW |

The control system 136 uses the crusher 102 as a measurement instrument to determine which type of material that is presently crushed in the crusher 102. If, for example, the measured power, as forwarded in signal M1, is 200 kW, and the width of the gap GP is 100 mm then the control system 136 may determine, from data of table 2, that the material MR presently fed to the crusher 102 comprises a large amount of impurities. If, on a later occasion, the measured power increases to 400 kW, at the same width of the gap GP, then the control system 136 may determine that the material MR presently fed to the crusher 102 comprises a small amount of impurities. In response to such finding, the control system 136 may send a signal S4 to a drive motor 148 of the collecting station 138 to the effect that the drive motor 148 is to turn the conveyor 144 to such a position that the crushed material MC is directed to the second material location 142 instead of to the first material location 140. Furthermore, the control system 136 may send a signal S5 to the hydraulic cylinder 118 to adjust the width of the gap GP from 100 mm to 200 mm. Hence, the control system 136 uses the crusher 102 as a measurement instrument to determine which type of material that is presently crushed in the crusher, and controls the collecting station 138 to direct the material with a large amount of impurities to the first material location 140, and to direct the material with a small amount of impurities to the second material location 142. The control system 136 also controls the crusher 102 by adjusting the width of the gap GP by means of the hydraulic cylinder 118, such that each type of material is crushed in the most suitable manner with regard to the intended use of the crushed material MC in question.

It will be appreciated that numerous variants of the embodiments described above are possible within the scope of the appended claims.

Hereinbefore, it has been described that the method and crushing system may be applied to a gyratory crusher 2 of the inertia cone crusher type, or a crusher 102 of the jaw crusher type. It will be appreciated that the present invention may also be applied to other types of crushers. For example, the present invention could also be applied to gyratory crushers of the type having a fixed eccentric, such as disclosed in U.S. Pat. No. 4,034,922.

Hereinbefore it has been described that the measured crushing parameter may involve the power consumption of the crusher. It will be appreciated that other crushing parameters could also be measured to be used a basis for analysing what type of material is crushed in the crusher. Examples of such other crushing parameters include hydraulic pressure of a crusher, vibrations of a crusher, temperature of the crusher, temperature of a lubricant lubricating bearings of the crusher, etc. It is also possible to base the analysis of which type of material that is being crushed in the crusher on more than one crushing parameter. For example, in a crusher of the type disclosed in U.S. Pat. No. 4,034,922, the analysis of the type of material being crushed could be based on the measured power consumed to rotate the eccentric and the measured hydraulic pressure in a piston arrangement moving a crusher head shaft in a vertical direction.

Hereinbefore it has been described that the control system 136 may control the width of a gap GP between the fixed crushing plate 104 and the movable crushing plate 108 in a jaw crusher 102 to different settings depending on which type of material that is crushed in the jaw crusher 102. It will be appreciated that the control system 36 may also control the width of a gap between outer or inner crushing shells 4, 8 of a gyratory crusher, being of the inertia cone crusher type, or of the type with a fixed eccentric, to different settings depending on which type of material that is crushed in the gyratory crusher. Also other parameters that influence the crushing performance, and/or are influenced by the type of material being crushed in the crusher, may be controlled based on the analysis of which type of material that is being crushed in the crusher.

The invention claimed is:

1. A method of crushing material between a first crushing surface and a second crushing surface of a crusher, the method comprising the steps of:

measuring a crushing parameter; and analyzing, based on the measured crushing parameter, which of at least two different type of materials is being crushed in the crusher.

2. A method according to claim 1, the method further comprising the step of, subsequently to analyzing which type of the at least two different materials being crushed in the crusher, determining whether or not a change of material being crushed has occurred.

3. A method according to claim 1, further comprising the step of selecting a destination, from at least two alternative destinations, to which the crushed material is to be forwarded based on the analysis of which type of the at least two different types of materials is being crushed in the crusher.

4. A method according to claim 1, further comprising the step of selecting a setting for at least one crusher operating parameter, from at least two alternative settings of the crusher operating parameter, based on the analysis of which type of the at least two different types of materials being crushed in the crusher.

5. A method according to claim 4, wherein the crushing parameter includes the power consumption of the crusher.

6. A method according to claim 1, further comprising the step of selecting a setting for at least one operating parameter of downstream equipment treating crushed material coming from the crusher, from at least two alternative settings of the operating parameter, based on the analysis of which type of the at least two different types of materials being crushed in the crusher.

7. A crushing system comprising:

a crusher having a first crushing surface and a second crushing surface for crushing a material there between; and a control system arranged to measure at least one crushing parameter, to analyze, based on the at least one crushing parameter, which type of material that is being crushed in the crusher, and to determine whether or not a change of material being crushed has occurred.

8. A crushing system according to claim 7, further comprising a material collecting station arranged for collecting material crushed in the crusher, the control system controlling the material collecting station based on the type of material that is being crushed in the crusher.

9. A crushing system according to claim 7, the control system further being arranged to control at least one crusher operating parameter of the crusher based on the analyzed type of material that is being crushed in the crusher.

10. A crushing system according to claim 7, the control system further being arranged to control at least one operating parameter of a downstream apparatus treating crushed material coming from the crusher based on the analyzed type of material that is crushed in the crusher.

11. A crushing system according to claim 7, wherein the crusher is a crusher selected among gyratory crushers and jaw crushers.

12. A crushing system according to claim 11, wherein the crusher is an inertia cone crusher.

* * * * *